United States Patent [19]

Mokadam

[11] Patent Number: 5,034,716

[45] Date of Patent: Jul. 23, 1991

[54] RADIAL COOLED AUTOTRANSFORMER ASSEMBLY

[75] Inventor: Raghunath G. Mokadam, Rockford, Ill.

[73] Assignee: Sundstrand Corporation, Rockford, Ill.

[21] Appl. No.: 433,670

[22] Filed: Nov. 8, 1989

[51] Int. Cl.[5] ..... H01F 27/08

[52] U.S. Cl. ..... 336/60; 336/180

[58] Field of Search ..... 336/60, 55, 57, 59, 336/180

[56] References Cited

U.S. PATENT DOCUMENTS

| | | | |
|---|---|---|---|
| 694,673 | 3/1902 | Schwedtmann | 336/60 X |
| 834,148 | 10/1906 | Lord | 336/60 |
| 834,160 | 10/1906 | Nichols | 336/60 |
| 873,166 | 12/1907 | Nichols | 336/60 X |
| 1,342,310 | 6/1920 | Steinberger | 336/60 |
| 1,527,810 | 2/1925 | Manegold | 336/60 |
| 1,529,570 | 3/1925 | Bethke | 336/60 |
| 1,546,885 | 7/1925 | Burnham | 336/60 |
| 3,195,085 | 7/1965 | Moore | 336/60 |
| 4,675,637 | 6/1987 | Fevrier et al. | 336/58 |
| 4,796,143 | 1/1989 | Odenkirchen et al. | 336/60 X |

FOREIGN PATENT DOCUMENTS

| | | | |
|---|---|---|---|
| 2218659 | 10/1973 | Fed. Rep. of Germany | 336/60 |
| 2812466 | 9/1979 | Fed. Rep. of Germany | 336/60 |
| 630070 | 11/1927 | France | 336/60 |
| 134181 | 7/1929 | Switzerland | 336/60 |
| 249488 | 6/1947 | Switzerland | 336/60 |
| 246798 | 10/1947 | Switzerland | 336/60 |
| 26251 | 2/1899 | United Kingdom | 336/60 |

*Primary Examiner*—Thomas J. Kozma

*Attorney, Agent, or Firm*—Marshall, O'Toole, Gerstein, Murray & Bicknell

[57] ABSTRACT

An inexpensive autotransformer assembly adapted to withstand and operate under stingent conditions for permitting the flow of a fluid in both the axial and radial directions therethrough to cool both the core and the windings is disclosed. A first embodiment comprises an autotransformer assembly having a core and at least two groups of windings spaced apart thereon. The core includes a central cooling channel and a plurality of radial channels extending outwardly from the central cooling channel and terminating at openings in the outer surface of the core. A second embodiment comprises an autotransformer assembly having a core and at least two groups of windings thereon. A plurality of longitudinal spacers disposed on the outer surface of the core serve as a means for spacing the windings from the core in order to provide an axial coolant path along the outer surface of the core.

13 Claims, 2 Drawing Sheets

RADIAL COOLED AUTOTRANSFORMER ASSEMBLY

TECHNICAL FIELD

The present invention relates generally to the cooling of autotransformers, and more particularly to cooling the autotransformer's core and the windings thereon.

BACKGROUND OF THE INVENTION

An autotransformer is often used to step-up or step-down voltage. It usually consists of one or more windings wound on a core. A typical single phase autotransformer includes first and second end terminals or taps and an intermediate tap at which an output voltage is developed. During operation, electrical energy is transformed into heat energy due in large part to copper losses, eddy currents and hysteresis losses. Excessive heating of the autotransformer can cause adverse results such as loss of power and damage to the autotransformer. The prior art discloses attempts to obviate this problem with efforts to cool transformers or parts thereof. Unfortunately, the prior art devices often are not entirely satisfactory. In some instances the cooling systems are too complicated, expensive or inefficient in cooling both the core and windings. In other instances, the device is not capable of performing properly under severe conditions, such as where a transformer is located in a device which is subjected to conditions of yaw, pitch and roll.

Moore, U.S. Pat. No. 3,195,085, discloses one prior art system in which cooling ducts in a foil or sheet wound transformer are formed by a series of holes placed in the sheet. The sheet is wound to form a coil, and the holes in the sheet overlap and form a cooling duct. The ducts which are formed extend radially outward from the interior of the structure. No elements or means are disclosed in this patent for cooling both a core and separately wound wires or groups of wires wrapped around the core.

German Patent No. 2,218,659 discloses a cooling system which includes multiple, axial channels disposed concentrically around the core that run parallel to one another and are between the individual, concentric windings. The parallel channels are formed by winding the coils on coaxial formers of increasing diameter that are placed around the core and supported radially by spacers. No provision is made for the radial flow of coolant between individual, spaced apart groups of windings.

United Kingdom Patent No. 26,251 discloses a device which is cooled by the radial flow of coolant between groups of windings and axial flow along the core. However, this device uses a plurality of radial insulating strips placed between the groups of windings to provide a space between the primary and secondary windings.

Other patents, such as Swiss Patent Nos. 46,798 and 249,488 and Fevrier et al., U.S. Pat. No. 4,675,637, disclose internal channel systems which are limited to either cooling the transformer's core or the windings.

What is desired is a relatively inexpensive cooling system for an autotransformer whereby both the core and the windings are cooled. Further, it is desired to utilize a minimal number of components to achieve the desired cooling. Moreover, it is desired that the autotransformer device utilize a cooling system which is adapted to withstand and operate under stringent conditions, such as where the device is subjected to multidirectional movements and forces.

SUMMARY OF THE INVENTION

The invention disclosed and claimed herein seems to obviate the problems and shortcomings associated with the prior art and to achieve the features desired in an autotransformer cooling system.

The present invention is directed to an improved cooling system for an autotransformer which is subjected to stringent conditions, as in an aircraft, where the autotransformer is subjected to multidirectional movements and forces. Moreover, the invention permits flow of fluid to cool both the windings and core.

Briefly, a first embodiment of the invention comprises an autotransformer assembly having a core and at least two groups of windings spaced apart thereon. The core includes a central cooling channel. A plurality of radial channels extend outwardly from the central cooling channel and terminate at openings in outer core surface. Cooling fluid, such as air, flows through the central cooling channel and radial cooling channels where the fluid exits and flows about the groups of windings wrapped about the core.

A second embodiment of the invention comprises an autotransformer assembly having a core and at least two groups of windings spaced apart thereon. A plurality of longitudinal spacers disposed on the outer surface of the core serve as a means for spacing the windings from the core in order to provide an axial coolant path along the outer surface of the core. Coolant flows within the axial passage formed by the longitudinal spacers and also flows radially outward whereby both the core and the windings are cooled.

Other advantages of the present invention will become apparent upon reading the following description of the drawings and the detailed description of the invention.

DETAILED DESCRIPTION OF THE INVENTION

Figure 1:
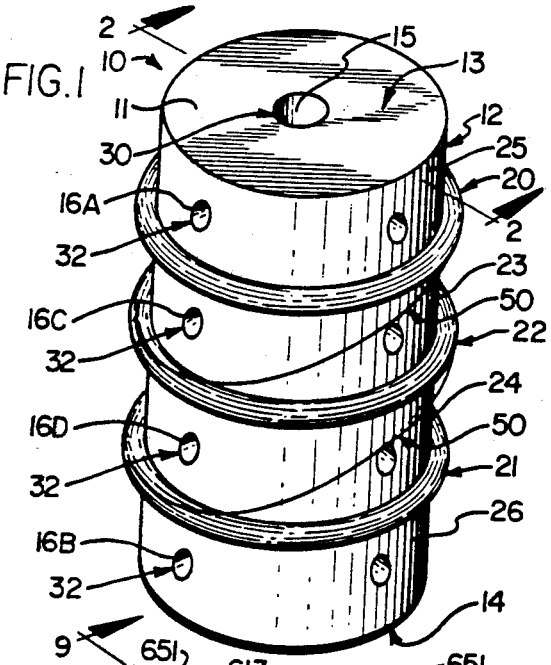
FIG. 1 a schematic partial perspective view of a first embodiment of the invention and includes an autotransformer having a core, groups of windings and cooling channels.
Figure 2:
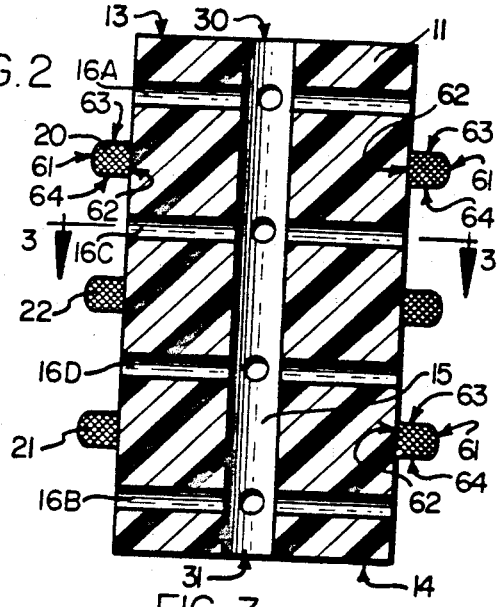
FIG. 2 shows a cross-sectional view taken along lines 2—2 in FIG. 1.
Figure 3:
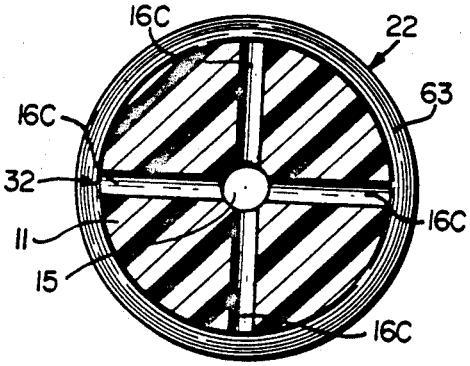
FIG. 3 shows a cross-sectional view, taken along lines 3—3 in FIG. 2.

Referring to the drawings wherein similar components or elements have similar reference numbers, FIGS. 1–7 show an autotransformer made in accordance with a first preferred embodiment of the present invention. In FIGS. 1–3, autotransformer 10 comprises core 11 having an outer surface 12, and a front end 13 and back end 14. Groups of windings 20, 21, 22 are wrapped about the outer core surface 12. A front group of windings 20 is located contiguous to front end 13 and a back group of windings 21 is located contiguous to back end 14. The core area located between front end 13 and windings 20 defines a front section 25, whereas the core area between back end 14 and windings 21 defines back section 26. The core area between any adjacent groups of windings, i.e. groups 20 and 22, groups 22 and 21, defines gap sections 23, 24. A middle group of windings 22 is disposed between windings 20 and windings 21. It is understood that additional groups of windings can be utilized, if desired, between front and back windings 20, 21.

Each group of windings 20, 21, 22 commonly comprises one or more insulated wires wrapped about outer surface 12 of core 11. Each group can be a single wire wrapped multiple times around the core, or each group can be multiple wires wrapped around the core. Windings 20, 21, 22 are spaced apart with each group being typically connected or tapped to an input and output circuit (not shown). The groups are often interconnected by wires, such as shown generally as connectors 50. The outer surface of the outer windings in each group comprise top peripheral surface 61, bottom peripheral surface 62, and side peripheral surfaces 63, 64.

Figure 4:
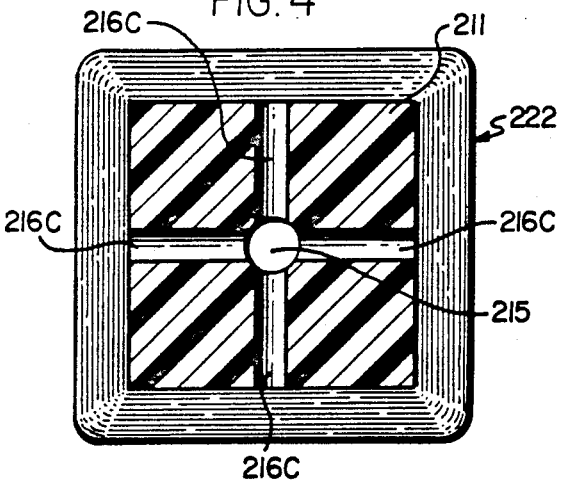
FIG. 4 shows a cross-sectional view similar to the one in FIG. 3 except that the core has a square cross-section.
Figure 11:
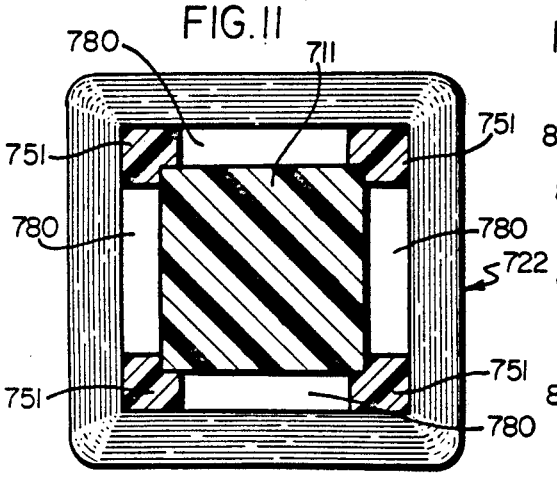
FIG. 11 is a cross-sectional view similar to the one of FIG. 10 except the core has a square cross-section and there are four longitudinal spacers.
Figure 12:
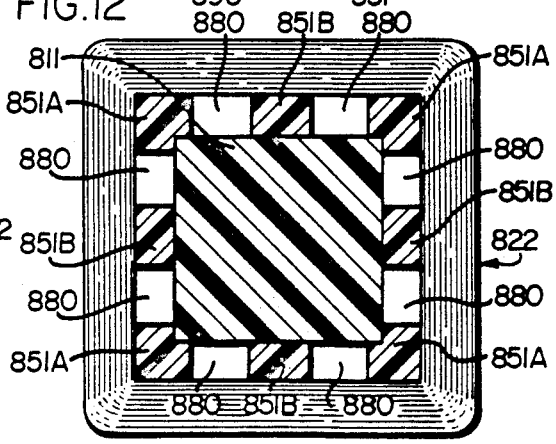
FIG. 12 shows a cross-sectional view similar to the ones shown in FIGS. 10 and 11 except there are eight longitudinal spacers.

Core 11 comprises a laminated stack of magnetically permeable material, typically iron. The core need not have a circular cross-section. It may have other configurations, such as rectangular or square, as shown in FIGS. 4, 11 and 12.

FIGS. 2 and 3 show central cooling channel 15 which extends along the entire length of core 11. Channel 15 includes front opening 30 and back opening 31.

A plurality of radial channels 16A, 16B, 16C, 16D are connected to and extend radially outwardly from cooling channel 15. Each radial channel 16A, 16B, 16C, 16D is smaller in diameter than the diameter of channel 15 and extends through the core and terminates at radial opening 32 on core surface 12. Cooling fluid is adapted to pass through cooling channel 15 where it branches off into the radial channels and exits core radial openings 32 to cool outer surface 12 and peripheral surfaces 61, 63, 64 of each group of windings 20, 21, 22.

A plurality of sets of radial channels are further provided (designated as A, B, C, D) within core 11. The sets are positioned to branch outwardly in the front section 25 (16A), in the back section 26 (16B) and in the gap sections 23, 24 (16C and 16D) so that a coolant can flow from channel 15, through the specific core sections 23, 24, 25, 26 and out openings 32 located in front, in between and in back of each group of windings, and into the areas in front, in back, and in between the groups of windings. In this manner, coolant can cool core 11, outer surface 12, and the peripheral surfaces 61, 63, 64 of windings 20, 21, 22.

As the number of groups of windings increases, additional sets of radial channels can be provided for each additional gap section generated. In this manner, coolant exiting openings 32 flows directly over the additional peripheral surfaces of each additional group of windings.

It has been found that for a particular application, the core and windings often must be cooled to a certain temperature. So long as the core and windings located contiguous to the back or exit end of the autotransformer are maintained below the specified temperature, desired cooling is achieved. Accordingly, it is appreciated that while the core and windings near the back end of the core are not cooled to the same degree as the core and windings located near the front end of the core where the coolant normally enters the core, the cooling is nevertheless satisfactory for a particular application.

Further, while coolant has been described entering front opening 30, it is appreciated that the coolant could, if desired, enter the core at opening 31 or through one or more openings 32.

Moreover, in certain applications, such as where two autotransformers are stacked in series, i.e., front to back, it is desirous to have coolant flow through front opening 30 of the first autotransformer and out its back opening 31 into the front opening 30 of the second autotransformer. Coolant can thus flow through both autotransformers' central cooling channels 15 and radial channels 16A, 16B, 16C, 16D. In other applications, it is desirous to cap or plug back opening 31 in order to prevent coolant from exiting core 11 through opening 31. In this manner, coolant entering core 11 through front opening 30, exits only through radial openings 32, or alternatively, coolant may enter through openings 32 and exit only through opening 30.

Although four radial channels are shown in each set of radial channels 16A, 16B, 16C, 16D, the number can vary.

Further, each radial channel 16A, 16B, 16C, 16D can radiate from central cooling channel 15 at angles other than the ninety degrees shown.

Additionally, while the channels are shown to have circular cross-sections, they may have other shapes, such as square or rectangular.

Moreover, various channels can be sized to accommodate different amounts of coolant flowing therein, different numbers of radial channels, and the temperatures desired.

Figure 5:
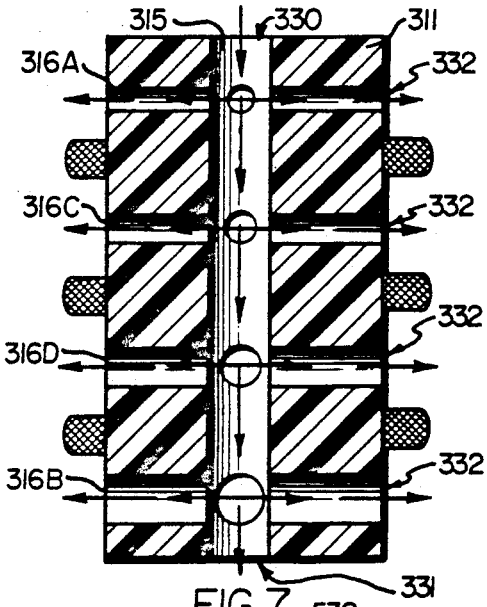
FIG. 5 shows a cross-sectional view similar to the one in FIG. 2 wherein the radial channels vary in cross-sectional area.
Figure 6:
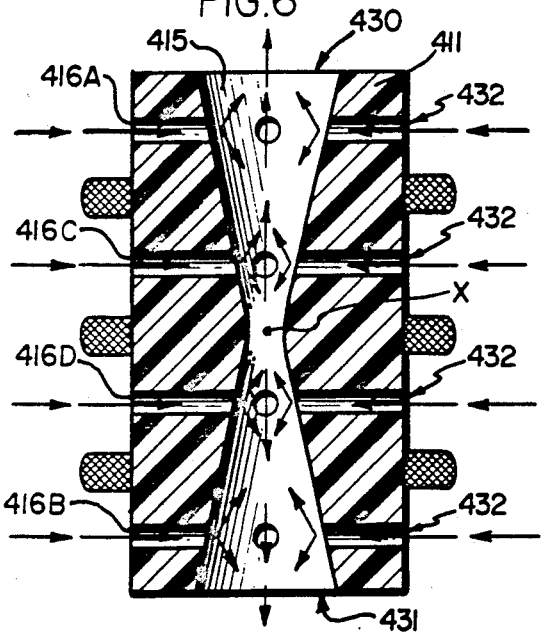
FIG. 6 shows a cross-sectional view similar to the ones in FIGS. 2 and 5 wherein the central cooling channel is of varying cross-sectional area along its length.
Figure 7:
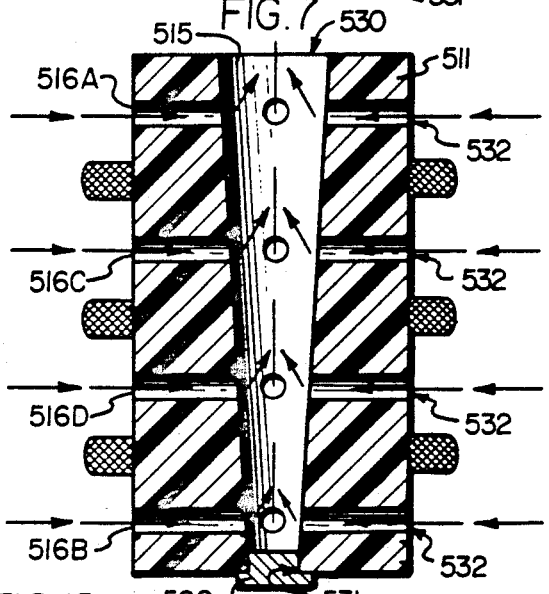
FIG. 7 shows a cross-section view similar to the ones in FIGS. 2, 5 and 6 wherein the central cooling channel is tapered along its length.

For example, FIGS. 5, 6 and 7 show different sizing arrangements for the channels. Specifically, it has been found that as a particular channel's length increases, there is an increase in friction on the flow of coolant. Such resistance can hamper the flow of coolant through the core and the various channels and prevent a uniform flow of coolant out of the channels. Moreover, the amount of energy required to pump coolant through the assembly must be increased to overcome this increase in friction on the flow of coolant. One solution to counteract such frictional increase and to obtain a more efficient and uniform flow of coolant, is to increase the channel's cross-sectional area.

As shown in FIG. 5, coolant (shown by the arrows) enters core 311 through front opening 330 and flows through central channel 315 and radial channels 316A, 316B, 316C, 316D and out radial channel openings 332 and back opening 331. The cross-sectional area of each of the radial channels 316A, 316B, 316C, 316D progressively increases as the channels increase in distance from the coolant inlet opening 330. Accordingly, radial channels 316C have a greater diameter and cross-sectional area than radial channels 316A; radial channels 316D have a greater cross-sectional area than channels 316C; and channels 316B have a greater cross-sectional area than channels 316D.

While central channel 315 is shown to be uniform in cross-sectional area, it, too, can have a cross-sectional area that increases as the longitudinal distance from the coolant inlet opening 330 increases. It is further appreciated that each radial channel 316A, 316B, 316C, 316D need not be of uniform cross-sectional area but instead can be tapered whereby the channel's cross-sectional area increases from its inlet, i.e., the point where the radial channel branches out from central channel 315, to its outlet radial opening 332. In this manner, a more uniform flow of coolant out of the radial channels and around the windings can be obtained.

Referring to FIGS. 6 and 7, coolant is introduced into the cores 411 and 511 through the radial openings 432 and 532 respectively. In FIG. 6, the central cooling channel 415 has an hourglass shape and tapers from its ends inwardly towards its longitudinal midpoint (shown as point X) so that its largest cross-sectional area is located at its front opening 430 and back opening 431. In this manner, coolant introduced through radial openings 432 can more efficiently flow through core 411 and out openings 430 and 431. In FIG. 7, the central cooling channel 515 tapers inwardly in a direction from front opening 530 to back opening 531 whereby the channel's largest cross-sectional area is located at front opening 530. Back opening 531 can be plugged or capped by a plug 590. In this manner, coolant introduced through radial openings 532 can more efficiently flow through core 511 and out opening 530.

It is further appreciated that although the radial channels in the cores of FIGS. 6 and 7 are shown to have uniform cross-sectional areas, they may be further sized, i.e. tapered, enlarged, reduced, to obtain the desired flows and temperatures.

A suitable coolant is air, although it is appreciated that other coolants may be employed. In those instances where the autotransformer is in a device which is subjected to different movements and forces, e.g., in an aircraft, air can be relatively easily introduced into the assembly and allowed to escape into the surrounding atmosphere. Other coolants, such as oil can be utilized; however, the use of such fluids requires that the fluid be recaptured and recirculated through the assembly. When air is utilized as the cooling medium, it may be introduced by a positive air generating means, such as by one or more fans or blowers used in conjunction with suitable ducting located at different locations in the autotransformer.

Figure 8:
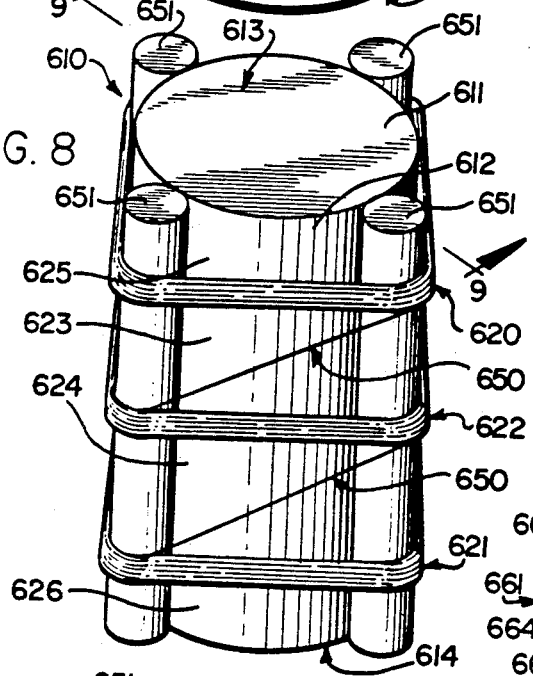
FIG. 8 shows a schematic partial perspective view of a second embodiment of the invention and includes an autotransformer having a core, windings and longitudinal space between the core and windings.
Figure 9:
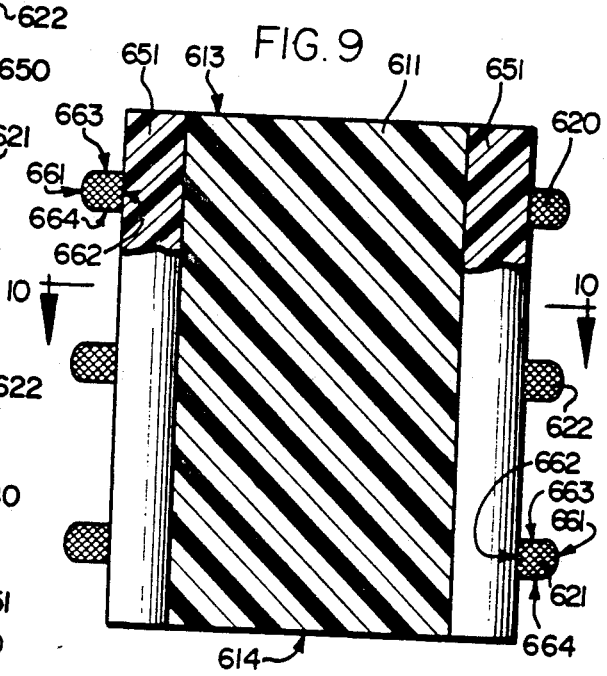
FIG. 9 shows a cross-sectional view taken along lines 9—9 in FIG. 8.
Figure 10:
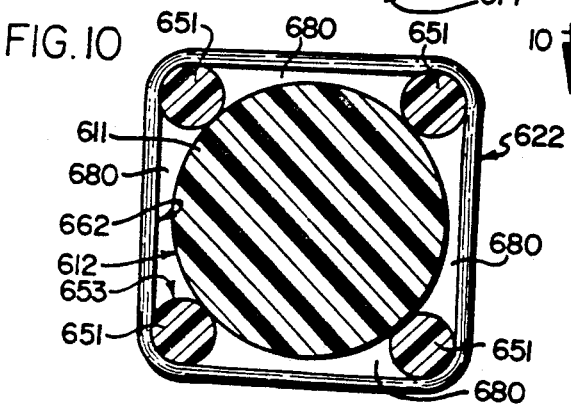
FIG. 10 shows a cross-sectional view along lines 10—10 in FIG. 9.

FIGS. 8–12 show an autotransformer made in accordance with a second preferred embodiment of the present invention. In FIGS. 8 10, autotransformer 610 comprises a core 611 having an outer surface 612, a front end 613, and a back end 614. Individual groups of windings 620, 621, 622 are spaced apart from each other and also are spaced from the outer surface 612 of core 611. Connectors 650 serve to connect the windings 620, 621, 622. Windings 620, 621, 622 and core 611, absent the internal channels, are similar to windings and core disclosed in the first preferred embodiment. With the second embodiment, there is provided front section 625 located between front end 613 and windings 620. Back section 626 is disposed between back end 614 and windings 622. Gap sections 623, 624 are located between the windings 620, 622 and 622, 621.

A plurality of distinct longitudinal spacers 651 are disposed on core outer surface 612 and extend along the core length.

The groups of windings are wrapped around the spacers 651 which serve as a means for spacing windings 620, 621, 622 from core 611. Spacers 651 provide an axial coolant passage 680 between windings 620, 621, 622 and outer core surface 612. Each spacer 651 has an outer surface 653 which contacts outer core surface 612 and the bottom peripheral surface 662 of windings 620, 621, 622. Consequently, an axial passage 680 is formed between outer core surface 612 and surface 662 of windings 620, 621, 622. Thus, coolant flows freely in axial passage 680 where it cools the core surface 612 and windings 620, 621, 622. Coolant also flows radially from passage 680 in the area surrounding the side 663, 664 and top 661 peripheral surfaces of the windings 620, 621, 622 to further cool the core surface 612 and windings 620, 621, 622.

It is understood that although the core 611 and the longitudinal spacers 651 are shown to have circular cross-sections, they can have other shapes, such as rectangular or square. Additionally, the number of longitudinal spacers may vary. For example, as shown in FIGS. 11 and 12, the core has a square cross-section. In FIG. 11, corner longitudinal spacers 751 are disposed between core 711 and the windings 722 to form axial coolant passage 780. In FIG. 12, corner longitudinal spacers 851A and rectangular spacers 851B are disposed between the core 811 and the windings 822 to form axial coolant passage 880.

While one or more embodiments of the invention have been herein illustrated and described in detail, it will be understood that modifications and variations thereof may be effected without departing from the spirit of the invention and the scope of the appended claims.

I claim:

1. An autotransformer assembly having a magnetic core with an outer surface and a plurality of spaced groups of windings wrapped about the core, said assembly comprising:

an axial cooling channel for cooling a surface of the core;

said axial cooling channel comprising a front opening on one side of said core and a back opening on an opposed side of said core;

radial cooling channels extending outwardly from said axial cooling channels for cooling said groups of windings; and a flow path from a coolant entrance to a first intersection between a first radial cooling channel and said axial cooling channel, to a second intersection between a second radial cooling channel and said axial cooling channel, to a coolant exit, the first radial channel having a first cross sectional area contiguous to the first intersection, the second radial channel having a second cross sectional area contiguous to the second intersection and the central channel having third and fourth cross sectional areas contiguous to the first and second intersections, respectively, wherein the sum of the second and fourth cross sectional areas is greater than the sum of the first and third cross sectional areas.

2. The autotransformer assembly of claim 1 wherein said axial cooling channel comprises a central cooling channel through the core, and said radial cooling channels extend outwardly from said central cooling channel and terminate at openings in the outer surface of the core.

3. An autotransformer assembly comprising:

a magnetic core having an outer surface, a front end, and a back end;

at least a front and a backgroup of windings spaced apart and wrapped about said core outer surface, each said group having peripheral surfaces;

a gap section of said core between said groups of windings;

a central cooling channel within said core including a front opening on said front end and a back opening on said back end and extending through the entire length of said core so that coolant can flow through and cool said core;

a plurality of radial channels extending between said central cooling channel and openings in said outer surface of said core so that coolant can flow through said radial channels to further cool said core and said peripheral surfaces;

said plurality of radial channels further being located in said gap section; and said central cooling channel and said radial channels providing a flow path from a coolant entrance to a first intersection between a first radial cooling channel and said central cooling channel, to a second intersection between a second radial cooling channel and said central cooling channel, to a coolant exit, the first radial channel having a first cross sectional area contiguous to the first intersection, the second radial channel having a second cross sectional area contiguous to the second intersection and the central channel having third and fourth cross sectional areas contiguous to the first and second intersections, respectively, wherein the sum of the second and fourth cross sectional areas is greater than the sum of the first and third cross sectional areas.

4. The autotransformer assembly of claim 3 further comprising:

a front section of said core between said front end and said front group of windings;

a back section of said core between said back end and said back group of windings; and a first set of radial channels being located in said front section, a second set of radial channels being located in said gap section, and a third set of radial channels being located in said back section.

5. The autotransformer assembly of claim 4 wherein the central channel's cross-sectional area tapers inwardly from said front opening to said back opening.

6. The autotransformer assembly of claim 4 wherein the central channel's cross sectional area increases as its longitudinal distance from said front opening increases.

7. The autotransformer assembly of claim 4 wherein the central channel has ann hourglasses shape and its cross-sectional area tapers from its ends inwardly towards its longitudinal midpoint.

8. The autotransforrmer assembly of claim 4 wherein the radial channels' cross-sectional areas progressively increases as the channels increase in distance from said front opening.

9. The autotransformer assembly of claim 4 wherein the coolant is air.

10. The autotransformer of claim 1 wherein said coolant entrance is adjacent said groups of windings and said coolant exit is one of said front and back openings.

11. The autotransformer of claim 10 wherein said axial cooling channel comprises a middle section having a relatively small cross-sectional area compared to the cross-sectional area of one of said front and back openings; and the cross-sectional area of said middle section increases continuously from said middle section to said front and back openings.

12. The autotransformer of claim 3 wherein said coolant entrance is one of said openings in said outer surface and said coolant exit is one of said front and back openings.

13. The autotransformer of claim 12 wherein said central cooling channel comprises a middle section having a relatively small cross--sectional area compared to the cross-sectional area of one of said front and back openings; and the cross-sectional area of said middle section increases continuously from said middle section to said front and back openings.

* * * * *